United States Patent [19]

Beerli et al.

[11] Patent Number: 4,819,310

[45] Date of Patent: Apr. 11, 1989

[54] APPARATUS FOR REGULATING THE WARP SECTION TENSION DURING WARPING

[75] Inventors: Markus Beerli, Kirchberg; Erich Guntli, Niederuzwil, both of Switzerland

[73] Assignee: Benninger AG, Uzwil, Switzerland

[21] Appl. No.: 31,818

[22] Filed: Mar. 30, 1987

[30] Foreign Application Priority Data

Apr. 2, 1986 [CH] Switzerland ..... 1286/86

[51] Int. Cl.[4] ..... D02H 13/24

[52] U.S. Cl. ..... 28/185; 28/191; 364/470

[58] Field of Search ..... 28/185, 191; 364/470

[56] References Cited

U.S. PATENT DOCUMENTS

| | | | |
|---|---|---|---|
| 3,481,011 | 12/1969 | Norton | 28/185 |
| 3,777,959 | 12/1973 | Seney | 28/185 X |
| 4,074,404 | 12/1978 | Schenk | 28/191 X |
| 4,141,120 | 2/1979 | Schenk | 28/191 X |
| 4,528,631 | 7/1985 | Bogucki-Land | 364/470 |

FOREIGN PATENT DOCUMENTS

| | | | |
|---|---|---|---|
| 3432276 | 4/1985 | Fed. Rep. of Germany | 28/191 |

OTHER PUBLICATIONS 0012235, 06/1980, European Patent, Theihsen et al.

*Primary Examiner*—Robert R. Mackey
*Attorney, Agent, or Firm*—Werner S. Kleeman

[57] ABSTRACT

During warping, the threads removed from the bobbins of a warp creel are supplied by means of a respective adjustable and settable thread brake to a reed located on the warping carriage of the warping machine and from that location the threads are ordered or arranged in a warp section prior to winding onto the warping drum. During operation of the warping machine, all of the thread brakes can be simultaneously adjusted by a central brake adjusting device controlled by control signals of a processor which, prior to the start of warping, stores by means of an input station, the warp section tension to be kept constant during operation, apart from other data. In the processor, the set or reference value of the warp section is constantly compared with actual value signals fed into the processor by a tension measuring device. If there exists a set value-actual value difference, the central brake adjusting device is controlled in the sense of correcting the thread tension by means of the thread brakes. The tension measuring device comprises a measuring roller which deflects the complete warp section between the reed and the warping drum and whose exposure to the warp section tension produces the actual value signal by means of displacement path transducers or pick-ups and this actual value signal is compared with the previously entered set or reference value in the processor.

6 Claims, 4 Drawing Sheets

Fo
Fu
F
100
110
120
63
8a
8b
8c
9a

Fig. 3
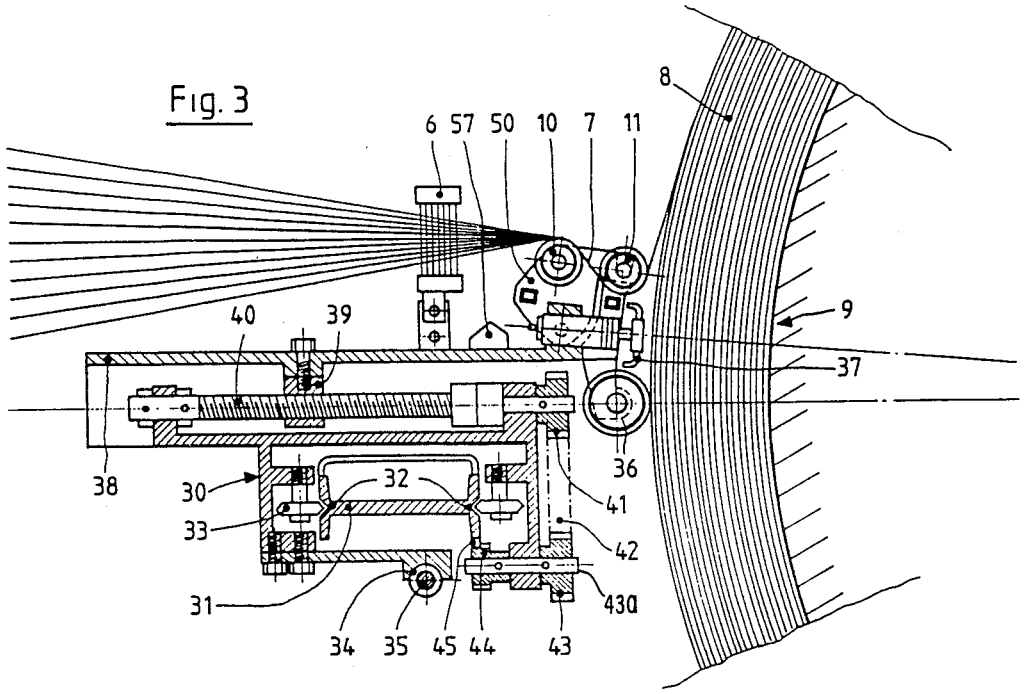
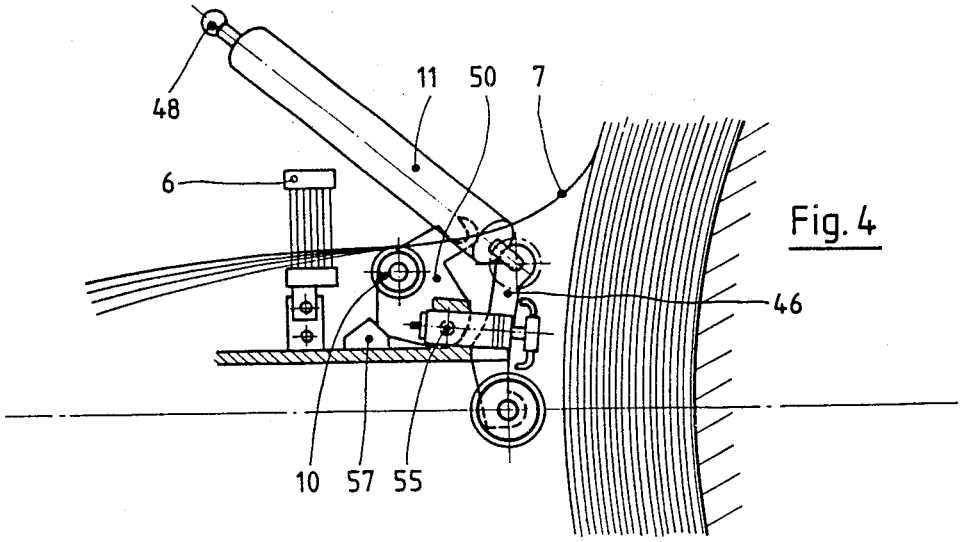
Fig. 4

APPARATUS FOR REGULATING THE WARP SECTION TENSION DURING WARPING

BACKGROUND OF THE INVENTION

The present invention broadly relates to a new and improved construction of an apparatus for regulating the warp section tension during warping.

In its more particular aspects, the present invention concerns an apparatus for regulating the warp section tension during warping, wherein warp threads are removed from the bobbins of a warp creel. Each of the warp threads are passed by means of a respective associated adjustable and settable thread brake to a reed arranged on the warping carriage of the warping machine and are there ordered or arranged in the form of a warp section prior to winding onto the warping drum. There is also provided a central brake adjustment device which is coupled with a tension measuring device and serves to automatically control the thread brakes during the operation of the warping machine.

Such an apparatus is known, for example, from German Patent Publication No. 2,853,662 published July 3, 1980. This known apparatus measures in each case the tension of a single thread, if desired for each side of the warp creel and the central adjustment of all of the thread brakes of the warp creel or the relevant warp creel side takes place on the basis of this single thread measurement. However, the tension of this single measured thread cannot be representative of the tension of all of the remaining, non-measured threads of a warp section, because, namely, the measured thread undergoes an additional deflection for performing the measurement operation and which does not occur in the case of the non-measured threads and also because the different tension conditions are ignored. These different tension conditions can be due to possible use of different threads or yarns or the like within a warp section or different bobbin diameters, as well as different positions of the bobbins in the warp creel.

Additionally, in this known apparatus the tension measuring device is located in the vicinity of the warp creel, so that no account is taken of any following locations or points in the thread travel or movement direction which also influence both the measured thread and the remaining threads, particularly those in the vicinity of the warping carriage, for example, the lease reed, the warp reed and possibly used further deflection rollers during regulation.

This leads to incorrect or at least imprecise tension measurement results. Thus, with the known apparatus, it is scarcely possible to control the central brake adjusting device such that the uniform thread tension of all the threads necessary for obtaining a completely satisfactory warp or warp sheet during warping is achieved. Moreover, in the known apparatus, thread tension regulation cannot take place at the time of starting or run-up of the warping machine.

In a different context, namely, beam warping machines, it is admittedly known, for example, from German Patent Publication No. 2,724,334, published Dec. 7, 1978 and Swiss Pat. No. 558,293 granted Dec. 15, 1974 to use a group of threads or thread field or parts thereof for measuring the winding tension. In the apparatus according to the aforementioned German Pat. No. 2,724,334, it is a question of measuring the tension of the threads running over a tension measuring roller independently of the varying wrap angle due to the increased application of the threads to the back beam. In the aforementioned Swiss Pat. No. 558,293, part of the material web width, for example, the threads from a creel stage are led over a measuring and control roll at the creel outlet and the measured values thereof are then used for controlling the winding speed.

SUMMARY OF THE INVENTION

Therefore, with the foregoing in mind, it is a primary object of the present invention to provide a new and improved construction of an apparatus which does not exhibit the aforementioned drawbacks and shortcomings of the prior art constructions.

Another important object of the present invention is to provide a new and improved construction of an apparatus for regulating the warp section tension, wherein the tension measuring device provides without limitation valid or accurate values for regulating the thread brakes for all of the threads forming the warp section, measures these values at a critical point or location and more precisely processes the same, particularly thereby ensuring a constant warp section tension not only during the actual warping operation, but also during the starting or run-up and braking or run-down of the warping machine.

Yet a further significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus for regulating the warp section tension during warping is manifested by the features that there is provided a respective adjustable and settable thread brake through which pass during warping, the threads which have been removed from the bobbins of the warping creel. These threads are then passed through a reed mounted on the warping carriage and from that location and prior to winding-up onto the warping beam the threads are ordered or arranged in the form of a warp section. There is also provided a tension measuring device for measuring the tension of the removed threads, and a central brake adjustment device is operatively coupled with the tension measuring device and automatically controls the adjustable and settable thread brakes during the operation of the warping machine. The tension measuring device comprises a measuring roller and at least one displacement path transducer or pick-up cooperates with the measuring roller. This measuring roller deflects the complete warp section between the reed and the warping drum. The measuring roller when exposed to the tension of the warp section produces an actual value signal representative of the tension of the warp section by means of the at least one displacement path transducer or pick-up. A processor cooperates with the at least one displacement path transducer or pick-up and the actual value signal is compared in the processor with a previously entered set or reference value and in the presence of a set value-actual value difference, there is controlled the central brake adjusting device in the sense of correcting the thread tension by means of the adjustable and settable thread brakes.

By virtue of the inventive measures, there are initially eliminated sources of error resulting from the fact that measured values are used for the overall regulation which only apply to parts of the thread field or group of threads to be wound and in extreme cases, only for a single thread. In the apparatus of the present development, it is not the measured tension of a single thread which is extrapolated, but, instead, the evaluated actual value corresponds to the tension of the complete warp section immediately prior to its winding onto the warping drum. There is no separate or particular loading or stressing of the threads used for the measurement as a result of the tension measurement operation; quite to the contrary, the same thread loading or stressing occurring at all of the threads of the warp section. The set value-actual value regulation functions independently of the thread travel or passage speed at any operating point of the warping process, particularly during the run-up or start and the run-down or stoppage of the apparatus or at different production rates for the first warp section and the following warp sections. Maintaining the set or reference warp section tension is also ensured independently of changes to the rotational speed of the warping drum and which are necessary for maintaining a constant thread draw-off speed, despite the growing package and also takes place independently of the application regulation or the warping carriage advance or feed.

According to a further aspect of the present invention, the measuring roller or roll is arranged between the reed and a deflection roller which is arranged upon the warping table and serves to deflect the threads to the warping drum. This measuring roller like the deflection roller can be moved out of the region of the thread field or group of threads into a rest position in which there is eliminated the deflection of the threads or the like. Furthermore, the measuring roller together with its bearing or mounting parts can be tiltably mounted upon the warping table between two stops or impact members about a tilt or pivot axis extending substantially parallel to the lengthwise axis of the measuring roller. The center of gravity of the measuring roller is located at the side thereof which faces away from the deflection roller. A bearing or mounting part is provided with a nose member or projection which in the operating position of the deflection roller, engages behind the shaft of the deflection roller and fixes the measuring roller together with its mounting or bearing parts in an instable tilted or pivoted position, and upon moving the deflection roller from the operating position into the rest position releases the measuring roller and during the reverse movement of the deflection roller again entrains such measuring roller.

By virtue of this design, the servicing of the warp machine or installation is facilitated. Moreover, it is possible by using one hand to grasp the deflection roller on a handle or hand grip and such deflection roller then can be moved out of the thread region and at the same time the measuring roller is also moved away so that the thread field or group of threads are freely accessible and access for performing desired manipulations is rendered possible. Additionally, this construction also affords a simple retrofitting of existing warping machines or installations with the inventive warp section tension regulation system.

A further aspect of the invention contemplates supporting the measuring roller at both of its ends upon displacement path transducers or pick-ups which generate actual value signals, the sum of which signals corresponds to the total loading of the measuring roller by the momentary tension of the warping section. This design makes it possible to measure and evaluate the momentary or instantaneous warp section tension independently of the position, density and width of the thread field or group of threads passing over the measuring roller.

Another feature of the present invention entails arranging the measuring roller, viewed in the direction of thread travel, upstream or forwardly of the deflection roller which is of the same size as the measuring roller. This positioning of the measuring roller in relation to the deflection roller is undertaken such that the angle of thread wrap by the thread field or group of threads is always at least approximately the same independent of the momentary package diameter of the threads wound upon the warping beam and the plane of the maximum tension always assumes the same position. This leads to a simplification of the design of the apparatus because for evaluating the tension acting on the measuring roller, there is no need to take account of the thread wrap angle and the relative position of the resultant to the tension measuring means or device because they are invariable.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 3 shows a vertical section through part of a warping machine with the warping carriage, the tension measuring device and the partly wound warping drum in the operating position;

FIG. 4 shows parts of the inventive apparatus according to FIG. 3 in the inoperative position, which facilitates manual working in the reed/warping drum area;

DETAILED DESCRIPTION OF THE PREFERRED EMBODIMENTS

Figures 1, 2A, 2B:
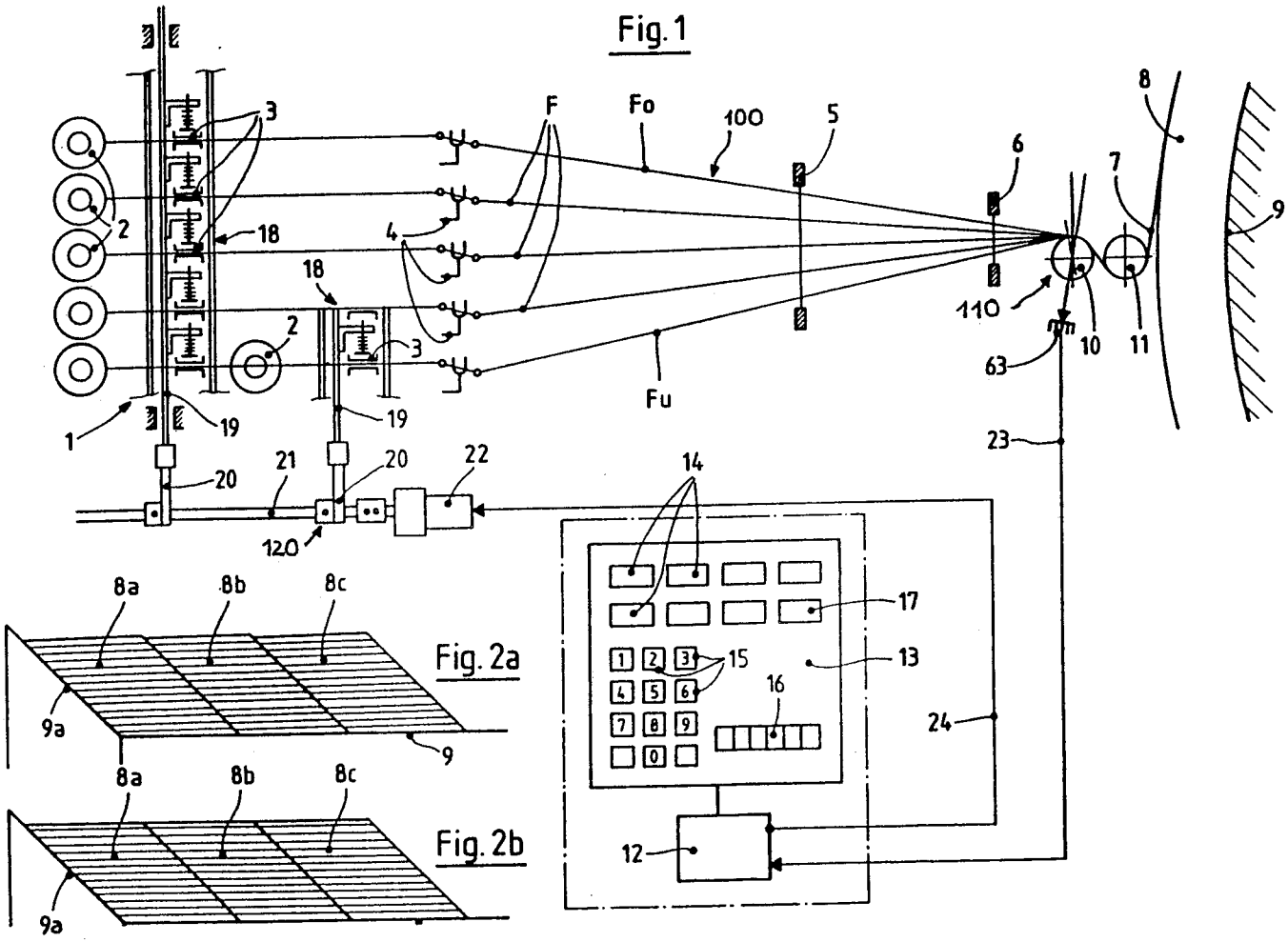
FIG. 1 is a schematic representation of a warping apparatus or machine utilizing the inventive warp section tension regulation and an input station.
FIGS. 2*a* and 2*b* diagrammatically illustrate the arrangement of the wound warp sections on the warping drum during warping without and when using the inventive warp section tension regulation means.

Describing now the drawings, it is to be understood that to simplify the showing thereof, only enough of the structure of the warping apparatus or machine has been illustrated therein as is needed to enable one skilled in the art to readily understand the underlying principles and concepts of the present invention. Turning now specifically to FIG. 1 of the drawings, the warping apparatus or machine illustrated therein by way of example and not limitation, will be seen to comprise a warp creel 1 upon which numerous bobbins 2 are closely arranged in horizontal superimposed levels or stages. Each thread F drawn from the bobbins 2 during the warping process passes through a respective adjustable and settable thread brake 3 operatively associated therewith and which imparts the necessary thread tension to the thread F, as well as a stop motion 4 which is utilized for establishing the presence of the related thread.

The threads F combined into a thread field or group of threads, as generally indicated by reference character 100, at the warp creel outlet are subsequently passed through a lease reed 5 and a reed or warping reed 6. The reed 6 arranges the thread field or group of threads to form a warp section 7 having the desired width and density which is then wound onto the warping drum 9 of the warping machine as the warp section 8. Between the reed 6 and the warping drum 9, the thread field or group of threads 100 is deflected by two rollers 10 and 11 wherein the first roller is a measuring roller or roll 10 of a tension measuring device, generally indicated by reference character 110 and the second roller is a deflection roller or roll 11 which guides the warp section 7 during the warping process until just before it runs-up onto or contacts the warping drum 9.

The thread brakes 3 of the warp creel 1 are not only individually adjustable to compensate for the different position and distance of the associated bobbin 2 from the reed 6, but are also centrally adjustable in conventional manner by a central brake adjusting device, generally indicated by reference character 120. For this purpose, all the thread brakes 3 of a vertical row arranged in a brake plate column 18 are simultaneously and identically adjustable by a control rod 19 and, in turn, all the control rods 19 of the warping creel 1 can be operated by a positioning or adjustment motor 22 by means of eccentrics or eccentric members 20 located on a shaft 21.

Prior to the commencing of warping, the textile and mechanical set or reference data are fed into a processor or microprocessor 12 which is, on the one hand, a data carrier and store and, on the other hand, determines data for the warp production and this, among other things, makes it possible for the processor 12 to control the warp carriage movements during the warping of successive warp sections as well as the warp section tension regulation described in greater detail hereinafter. Data input takes place by means of an input station 13 in which the different data are selected by means of selection keys 14 or the like and established or fixed by means of push-buttons 15, this inputted data being displayed in a display panel 16 and fed into the processor 12 by means of the input key 17. In particular, the input station 13 also makes it possible to store the number of threads of the warp section to be warped or the warp section width, thread density (threads per cm) and set or reference value of the warp section tension in the processor 12. The use of a processor or microprocessor for inputting desired data at warping machines is conventional and well known in this technology, as for instance, exemplified by the commonly assigned U.S. Pat. No. 4,141,120, granted Feb. 27, 1979, to which reference may be readily had.

During the operation of the warping apparatus or machine, the tension of the thread field or group of threads 100 running over the measuring roller or roll 10 is constantly measured by means of the tension measuring device 110 which will be explained more fully hereinafter, i.e. there is constantly measured the effective warp section tension immediately prior to or upstream of the warp section 7 running onto the warping drum 9 and this information is fed into the processor 12 as actual value signals by a line or conductor 23. The determined actual values are compared in the processor 12 with the set or reference value which has been inputted or fed in beforehand. If there is a set value-actual value difference, the processor 12 produces a control signal which operates the positioning motor 22 via a line or conductor 24 until, due to the thus accomplished adjustment of all the thread brakes 3, the measured actual value again coincides with the stored set or reference value.

The correction of any deviation of the warp section tension from the stored set or reference value takes place at each operating point of the apparatus, for example, during starting or run-up and braking or run-down of the warping drum 9. The maintaining of the stored warp section tension takes place independently of rotational speed changes of the warping drum 9 which are carried-out in order to keep the thread draw-off speed constant despite the increasing size of the thread package and also independently of the regulation of the warp section application or the warp carriage advance or feed and naturally also independently of changes to the production speed, that is between the winding of the first warp section and that of the following warp sections. As a result of the continuous regulation of the warp section tension, the changes in the thread tension due to the decrease in the bobbin diameter are immediately and continuously restored to the stored set or reference value. The set value-actual value regulation also makes it possible to correct a stored set or reference value for the warp section tension found to be too high or too low during the warping of the first section by feeding a corrected set or reference value into the processor 12 and copying this correction during the warping of the following warp sections. If threads have to be added or removed in individual warp sections, it is merely necessary to re-enter the amended thread numbers or warp section width in the input station 13. The consequently ensured maintenance of a constant warp section tension in all situations independent of the warp section width eliminates the greatly feared staircase effect of the warp sections wound in juxtaposed manner onto the warping drum 9 and ensures an absolutely uniform build-up of the thread package on the warping drum 9. For comparison, FIG. 2*a* shows a faulty package exhibiting the undesired staircase effect between the first warp section 8*a* and following warp sections 8*b* and 8*c*, such as occurs when warping without the aforementioned warp section tension regulation of the present disclosure, whereas, FIG. 2*b* shows the absolutely uniform build-up of the same warp sections when warping with the inventive warp section tension regulation.

The position, construction and operation of the tension measuring device 110 will now be described in greater detail relative to FIGS. 3 through 7.

FIG. 3 shows the warping carriage 30 of the warping machine. As is conventional and well known in this technology, the warping carriage 30 is displaceably guided laterally with respect to the warping drum 9 on a warping traverse or guide 31 running parallel to the warping drum 9. The warping traverse or guide 31 is provided with lateral guide grooves 32 which engage guide rolls 33 which are rotatably mounted in the warping carriage 30. A spindle nut 34 or equivalent is also fixed to the warping carriage 30 and is pierced by a carriage displacement spindle 35 which can be driven in both rotational directions by a suitable carriage displacement motor in order to conventionally continuously displace the warping carriage 30 and via it, the reed or warping reed 6 which guides the warp section 8, in accordance with the control commands or instructions supplied by the processor 12 during the warping of a warp section, so as to successively warp in juxtaposed manner on the warping drum 9, the first warp section 8*a* and then the following sections 8*b*, 8*c* (FIGS. 2*a* and 2*b*) in accordance with the inclination or slope of the drum cone 9*a*.

Due to the increase in the diameter of the thread package formed during warping on the warping drum 9, it is necessary during warping to move away from the latter the reed 6, the measuring roller 10 and the deflection roller 11, as well as an equalization or leveling roller 36 whose function is to equalize or level the package application and ultimately also a sensing element 37. This sensing element 37 senses the warp section application during a measuring phase at the start of warping and, if necessary, permits an optimization of the warping carriage advance or feed by the processor 12 via a set value-actual value comparison. For this purpose, members 6, 10, 11, 36 and 37 are mounted on a warping table 38 which is displaceable on the warping carriage 30 in a direction which is substantially perpendicular to the carriage displacement or warping drum axis. For this purpose, the warping table 38 carries a spindle nut 39. This spindle nut 39 is traversed or pierced by a warping table spindle 40 mounted in rotary manner on the warping carriage 30 and on whose one end there is mounted a belt pulley 41 which is connected in driving relationship via a belt 42 with a second belt pulley 43. The belt pulley 43 is mounted in freely rotatable manner on the warping carriage 30 and is drive-connected via a shaft 43*a* to a pinion 44. The pinion 44 engages with a rack 45 fixed to the warping traverse 31. The movement of the warping carriage 30 along the carriage displacement spindle 35 during the warping of a warp section brings about a simultaneous appropriate displacement or removal of the warping table 38 and the members carried by it from the warping drum 9 by means of the rack 45, the pinion 44, the belt pulley 43, the belt 42, the belt pulley 41, the warping table spindle 40 and the spindle nut 39. The transmission ratios are chosen in such a manner that the displacement of the warping table 38 is coordinated or matched to the increase in the size of the package diameter or thread package on the warping drum 9 taking place at the same time.

Figure 5A:
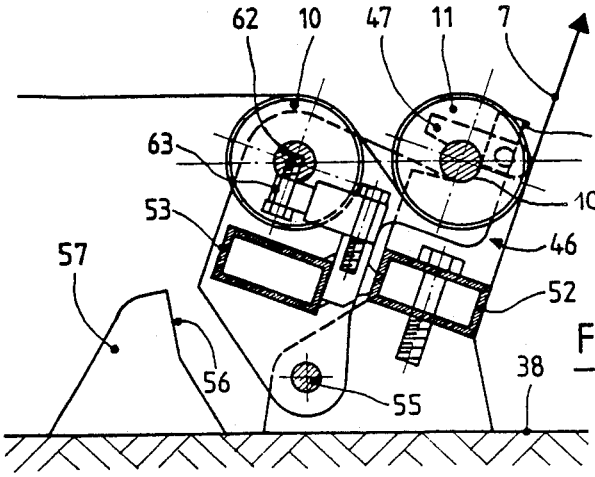
FIG. 5*a* shows on an enlarged scale, the tension measuring device in the operating or working position according to FIG. 3.
Figure 5B:
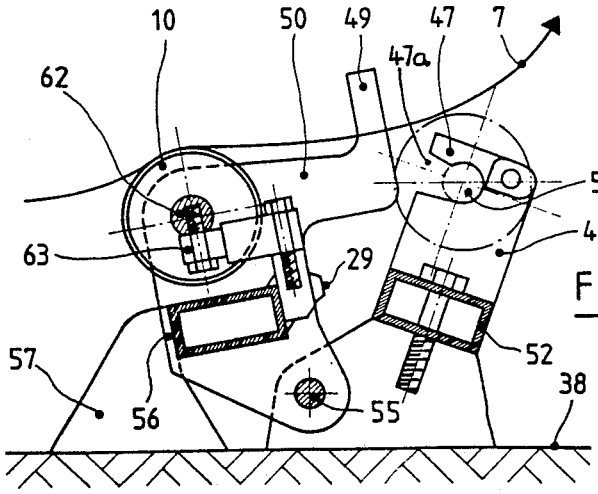
FIG. 5*b* shows on an enlarged scale, the tension measuring device in the inoperative position according to FIG. 4.

By means of the ends of its shaft 51, the deflection roller or roll 11 is mounted in rotary manner in a mounting support or holder structure 46 fixed to the warping table 38 and namely, with respect to FIGS. 5*a* and 5*b*, on the rear mounting or bearing side in swivel bearing, generally indicated by reference character 105, and on the front side connected to the rear side by a crossbar 52 in a mounting or bearing opening 47*a* closeable by a catch or pawl 47. Thus, following the manual opening of the catch or pawl 47, the deflection roller 11 is gripped by a handle 48 and can be tilted or swung-out of the operating position shown in FIGS. 3 and 5*a* into an inoperative or rest position shown in FIG. 4 in which the deflection of the group of threads of the warp section 7 brought about by it, is removed in the manner shown in FIG. 5*b* and manipulations by the machine operator are possible. The tilting or swinging-out or pivoting of the deflection roller 11 into the inoperative or rest position according to FIG. 4, simultaneously releases a projection or nose member 49 located on or provided at a pivot lever 50 which was held in the operating position according to FIG. 5*a* by the end of the shaft 51 of the deflection roller 11 fixed in its mounting or bearing opening 47*a* by the catch or pawl 47. By means of a crossbar or traverse 53, the pivot lever 50 is connected to a lever 54 on the opposite side (FIG. 6) and which is devoid of any projection or nose member. The two levers 50 and 54 mount in freely rotatable manner the measuring roller 10 of the tension measuring device 110. The arrangement is such that the center of gravity of the measuring roller 10, tiltable by means of the levers 50 and 54 about a pivot shaft or axis 55, is located to the left of such pivot shaft or axis 55 with respect to the showing of FIGS. 3 through 5*b*. Thus, during the swinging-out of the deflection roller 11 and the associated release of the projection or nose member 49, the measuring roller 10 tilts or pivots from its operating position according to FIG. 5*a* into an inoperative or rest position according to FIG. 5*b* in which it engages against a stop 56 of a cam or lug 57 or equivalent structure of the warping table 38.

Conversely, upon returning the deflection roller 11 from the pivoted or swung-out inoperative position according to FIG. 4 into the operating position according to FIG. 5*a*, the projection or nose member 49 of the swung-out mounting support for the measuring roller 10 is also moved and therefore, without any additional manipulations, the measuring roller 10 is also simultaneously returned into its operating position where it engages by means of a stop 29 on the crossbar or traverse 52.

Figure 7:
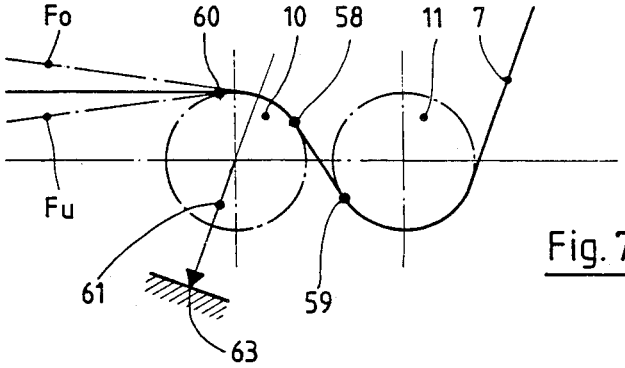
FIG. 7 is a diagrammatic representation for illustrating the warp section tension conditions in the vicinity of the tension measuring roller.

The diagrammatic representation of FIG. 7 reveals the course of the threads drawn from the creel in the vicinity of the measuring roller 10 and deflection roller 11. While the run-off point 58 of the threads from the measuring roller 10 as well as the run-on point 59 of the threads onto the deflection roller 11 remains unchanged throughout the warping process due to the operationally fixed position of the two identically large rollers 10 and 11, the run-on point 60 of the threads onto the measuring roller 10 differs slightly as a function of whether the threads come from an upper or lower stage or level Fo or Fu of the warp creel 1. However, it is possible to ignore the resulting minor differences of the thread wrapping of the measuring roller 10. The resultant force 61 (FIG. 7) of the forces exerted by the threads running over the measuring roller 10 upon the latter, runs in the plane of greatest tension containing the axis of the measuring roller 10 and bisects or halves the angle between the median run-on point 60 and the run-off point 58 of the threads onto or from such measuring roller 10.

Figure 6:
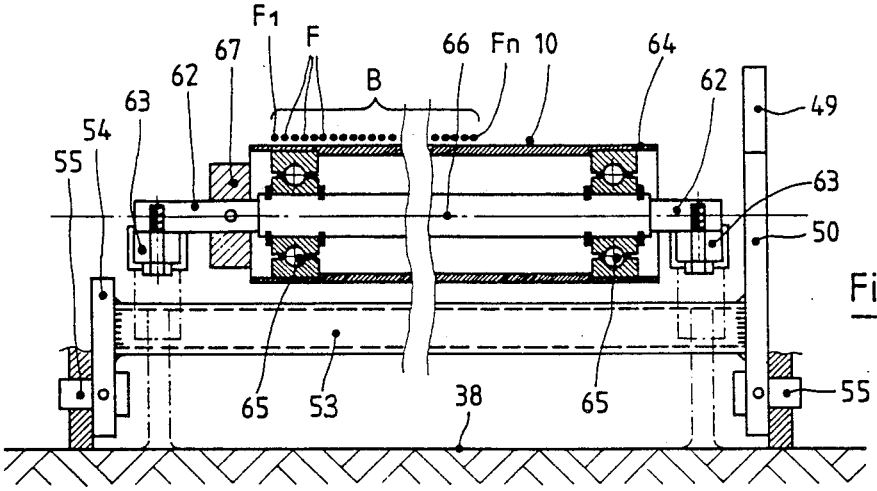
FIG. 6 shows a section through the tension measuring roller of FIGS. 5*a* and 5*b* and the mounting thereof.

As can be gathered from FIG. 6, the casing 64 of the measuring roller 10 is rotatably mounted by means of suitable ball bearings 65 on the measuring roller shaft 66. Each of the ends 62 of the measuring roller shaft 66 is supported on a displacement path transducer or pick-up 63 for measuring the warp section tension acting on the measuring roller 10. It would obviously also be conceivable to only support the measuring roller shaft 66 on one side on a displacement path transducer or pick-up and use the same for measuring the warp section tension. However, it would then always be necessary to redefine by means of the lever principle, the resultant force of the forces acting on the measuring roller 10. This requirement is obviated in the depicted arrangement provided with the two displacement path transducers or pick-ups 63 arranged on both sides of the measuring roller 10. This arrangement also has advantages. While the first thread $F_1$ of the warp section 7 running-over the measuring roller 10 is always at the same position independently of the warp section data (warp section width, thread density), the last thread $F_n$ of the warp section 7 moves as a function of the aforementioned parameters and the resulting warp section width B. The arrangement of two displacement path transducers or pick-ups 63 at both ends of the measuring roller 10 now makes it possible to determine the overall force by simply summating the force acting on each displacement path transducer or pick-up 63. These values are fed in the form of actual value signals into the processor 12 through the line or conductor 23 and, as mentioned hereinbefore, are compared in such processor 12 with the stored set or reference values and if a difference occurs, are used for correction by means of the central brake adjustment means 120.

It is also pointed out that the deflection roller 11, in the same way as the measuring roller 10, is rotatably mounted on its shaft by means of ball bearings and that the two rollers 10 and 11 are equipped with an electromagnetic brake 67 as indicated in FIG. 6 for the measuring roller 10. Thus, in the case of machine stoppage, the two rollers 10 and 11 can be stopped at the same time as the warping drum 9 and as a result of their identical construction, the braking action of the two rollers 10 and 11 is the same and there is no need for a separate control.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for regulating the warp section tension at a warping machine provided with a warping drum during warping of threads removed from the bobbins of a warp creel, comprising:

a respective adjustable and settable thread brake;

a warping carriage of the warping machine;

a reed mounted on the warping carriage;

said threads removed from the bobbins of the warp creel defining a thread field with each said thread passing through an associated one of the respective adjustable and settable thread brakes and then through said reed and being ordered at the region of the warping carriage in the form of a warp section prior to winding onto the warping drum;

a tension measuring device for measuring the tension of the removed threads;

a central brake adjustment device operatively coupled with said tension measuring device and automatically controlling the adjustable and settable thread brakes during the operation of the warping machine;

said tension measuring device comprising a measuring roller;

at least one displacement path transducer cooperating with said measuring roller;

deflection means arranged between said measuring roller and said warping drum;

said measuring roller and said deflection means deflecting the warp section located between the reed and the warping drum;

said measuring roller when exposed to the tension of the warp section producing an actual value signal representative of said tension of the warp section by means of said at least one displacement path transducer;

a processor cooperating with said at least one displacement path transducer; and said actual value signal being compared in said processor with a previously entered set value and in the presence of a set value-actual value difference controlling the central brake adjusting device in the sense of correcting the thread tension by means of said adjustable and settable thread brakes.

2. The apparatus as defined in claim 1, wherein:

said warping carriage includes a warping table supporting said measuring roller and said reed;

said deflection means containing a deflection roller carried by said warping table and serving for deflecting the threads onto the warping drum;

said measuring roller being positioned between said reed and said deflection roller;

means for enabling movement of the deflection roller from an operative position in engagement with the threads of the warp section into an inoperative position out of engagement with the threads of the warp section; and means for enabling movement of the measuring roller out of engagement with the threads of the warp section and into an inoperative rest position in which the threads are no longer deflected.

3. The apparatus as defined in claim 2, wherein:

said measuring roller has mounting means;

said measuring roller having a lengthwise axis and a center of gravity;

a pair of stop means between which there can move said measuring roller;

said mounting means constituting said means for enabling movement of said measuring roller and mounting said measuring roller to be tiltable upon said warping table between said pair of stop means about a tilting axis which extends substantially parallel to said lengthwise axis of said measuring roller and with the center of gravity of said measuring roller located on a side remote from said deflection roller;

a shaft provided for said deflection roller; and said mounting means including a mounting part provided with a projection which in said operative position of said deflection roller engages behind said shaft of said deflection roller and fixes said measuring roller together with said mounting means in an unstable tilting position and upon movement of said deflection roller from said opertive position into said inoperative position releases said measuring roller and during a reverse movement of said deflection roller again entrains said measuring roller.

4. The apparatus as defined in claim 1, wherein:

said at least one displacement path transducer comprises a pair of displacement path transducers;

said measuring roller having oppositely situated ends;

a respective one of said pair of displacement path transducers cooperating with a respective end of said oppositely situated ends of said measuring roller; and said pair of displacement path transducers producing actual value signals whose sum essentially corresponds to the total loading of said measuring roller by a momentary warp section tension.

5. The apparatus as defined in claim 1, wherein:

said measuring roller has oppositely situated ends;

means for mounting said measuring roller to be pivotable at said oppositely situated ends; and said at least one displacement path transducer cooperating with one end of said oppositely situated ends of said measuring roller and delivering to said processor as an actual value signal the loading of the measuring roller by a momentary tension of the warp section.

6. The apparatus as defined in claim 1, wherein:

the threads removed from the bobbins travel in a predetermined thread movement direction;

said deflection means containing a deflection roller for deflecting the threads onto the warping drum;

said measuring roller and said deflection roller possessing approximately the same diameter; and said measuring roller, viewed in said predetermined thread movement direction, being positioned in front of said deflection roller in such a manner that an angle of wrapping thereof by the threads of the warp section is at least approximately always constant independently of the package diameter of the threads wound upon the warping drum and a plane of greatest tension of the threads of the warp section always assumes essentially the same position.

* * * * *